US007174942B2

(12) United States Patent
Hsu

(10) Patent No.: US 7,174,942 B2
(45) Date of Patent: Feb. 13, 2007

(54) BLIND SLATS FOR DOOR/WINDOW VENETIAN BLIND

(75) Inventor: Ben Hsu, Changhua Hsien (TW)

(73) Assignee: Ching Feng Blinds Inc. Co., Ltd., Changhua Hsien (TW)

( * ) Notice: Subject to any disclaimer, the term of this patent is extended or adjusted under 35 U.S.C. 154(b) by 50 days.

(21) Appl. No.: 10/843,449

(22) Filed: May 12, 2004

(65) Prior Publication Data

US 2005/0252088 A1 Nov. 17, 2005

(51) Int. Cl.
*E06B 7/086* (2006.01)

(52) U.S. Cl. ..... 160/176.1 R; 49/74.1; 49/92.1

(58) Field of Classification Search ..... 160/166.1, 160/236, 174 R, 176.1 R; 49/74.1, 87.1, 49/92.1

See application file for complete search history.

(56) References Cited

U.S. PATENT DOCUMENTS 2,165,669 A * 7/1939 Wade ..... 160/176.1 R
3,451,165 A * 6/1969 O'Hair ..... 49/87.1
5,775,399 A * 7/1998 Shields, Jr. ..... 160/176.1 R
6,266,923 B1 * 7/2001 Lee ..... 49/87.1
6,276,429 B1 * 8/2001 Chen ..... 160/231.1
6,378,567 B1 * 4/2002 Chen ..... 139/383 R
6,880,611 B2 * 4/2005 Nien ..... 160/236

* cited by examiner

*Primary Examiner*—David Purol
(74) *Attorney, Agent, or Firm*—Troxell Law Office, PLLC

(57) ABSTRACT

Blind slats for door/window Venetian blinds include a door/window frame made up of a plurality of side brackets wherein the left and right side brackets are provided with a plurality of retaining holes disposed at the corresponding inner sides thereon respectively for blind slats to be mounted thereby, and a linkage rod is attached at the same side of the blind slats thereon. Each of the blind slats is formed of a flexible embodiment with a locating member attached at both shorter lateral sides thereon respectively to be registered with the retaining hole of the of the left/right side brackets thereof so as to attach the blind slat onto the door/window frame thereby. Via the flexibility thereof, each blind slat is capable of being pushed at both lateral sides thereof till slightly bent into an arc shape, permitting the locating members thereof to detach from the retaining holes of the left/right side brackets according to the deformation of the blind slat thereof. Thus, the blind slat is retrieved in a fast and easy manner for the replacement of a new blind slat mounted in the above-mentioned way without the door frame being troublesomely dismantled in the operation thereof, facilitating an easy and speedy dismounting as well as assembling of the blind slats for variation and replacement thereof.

8 Claims, 7 Drawing Sheets

BLIND SLATS FOR DOOR/WINDOW VENETIAN BLIND

BACKGROUND OF THE INVENTION

The present invention is related to blind slats for door/window Venetian blinds wherein left/right side brackets of a door/window frame are provided with a plurality of retaining holes at the corresponding inner sides thereon respectively for locating members of blind slats to be registered therewith so as to attach the blind slats onto the door/window frame thereby, and a linkage rod is mounted at the same side of the blind slats thereon. Via the flexibility of the blind slats thereof, each blind slat is capable of being pushed at both lateral sides thereof till slightly bent into an arc shape at the middle section thereof, permitting the locating members thereof to detach from the retaining holes of the left/right side brackets according to the deformation of the blind slat thereof. Thus, the blind slat is retrieved in a fast and easy manner for replacement of a new blind slat mounted in the above-mentioned way without the door/window frame being troublesomely dismantled in the operation thereof, facilitating an easy and speedy dismounting as well as assembling of the blind slats.

Please refer to FIG. 1. Conventional blind slats for door/window Venetian blinds include a door/window frame 10 made up of a plurality of side brackets 11 mounted into a frame body, a plurality of retaining holes 111 disposed at the corresponding inner sides of the left and right side brackets 11 thereon for pivotal posts 121 protruding at both lateral sides of each blind slat 12 to be registered therewith so as to locate the blind slats 12 onto the door/window frame 10 thereof, and a linkage rod 122 attached at the same side of the blind slats 12 to actuate the blind slats 12 synchronically upwards or downwards in the folding or unfolding operation of the Venetian blind thereof for sheltering effect thereof.

There are some drawbacks to such conventional blind slats for door/window Venetian blinds. Most of all, to dismount the blind slats 12 from the door/window frame 10 for variation of different styles or replacement of new ones, each of the side brackets 11 must be individually dismantled to detach the left/right side brackets 11 from the blind slats 12 thereof before new blind slats 12 are assembled onto the door/window frame 10 thereof, which is both troublesome and time-consuming in the operation thereof.

SUMMARY OF THE PRESENT INVENTION

It is, therefore, the primary purpose of the present invention to provide blind slats for door/window Venetian blinds wherein, via the flexibility of blind slats, each blind slat is capable of being pushed at both lateral sides thereof till slightly bent into an arc shape at the middle section thereof, permitting locating members attached at both lateral sides of the blind slat thereof to detach from retaining holes of left/right side brackets of a door/window frame according to the deformation of the blind slat thereof. Thus, the blind slat is retrieved in a fast and easy manner for replacement of a new blind slat without the door/window frame being troublesomely dismantled in the operation thereof, facilitating an easy and speedy dismounting as well as assembling of the blind slats for variation and replacement thereof.

It is, therefore, the second purpose of the present invention to provide blind slats for door/window Venetian blinds wherein each blind slat thereof is integrally molded without any other processing before engaged with the locating members at both lateral sides thereof for registration with the left/right side brackets of the door/window frame thereby, effecting a qualified production of the blind slats in an easy and speedy manner so as to boost the competitive power of the present invention in the market.

DETAILED DESCRIPTION OF THE PREFERRED EMBODIMENTS

Figure 1:
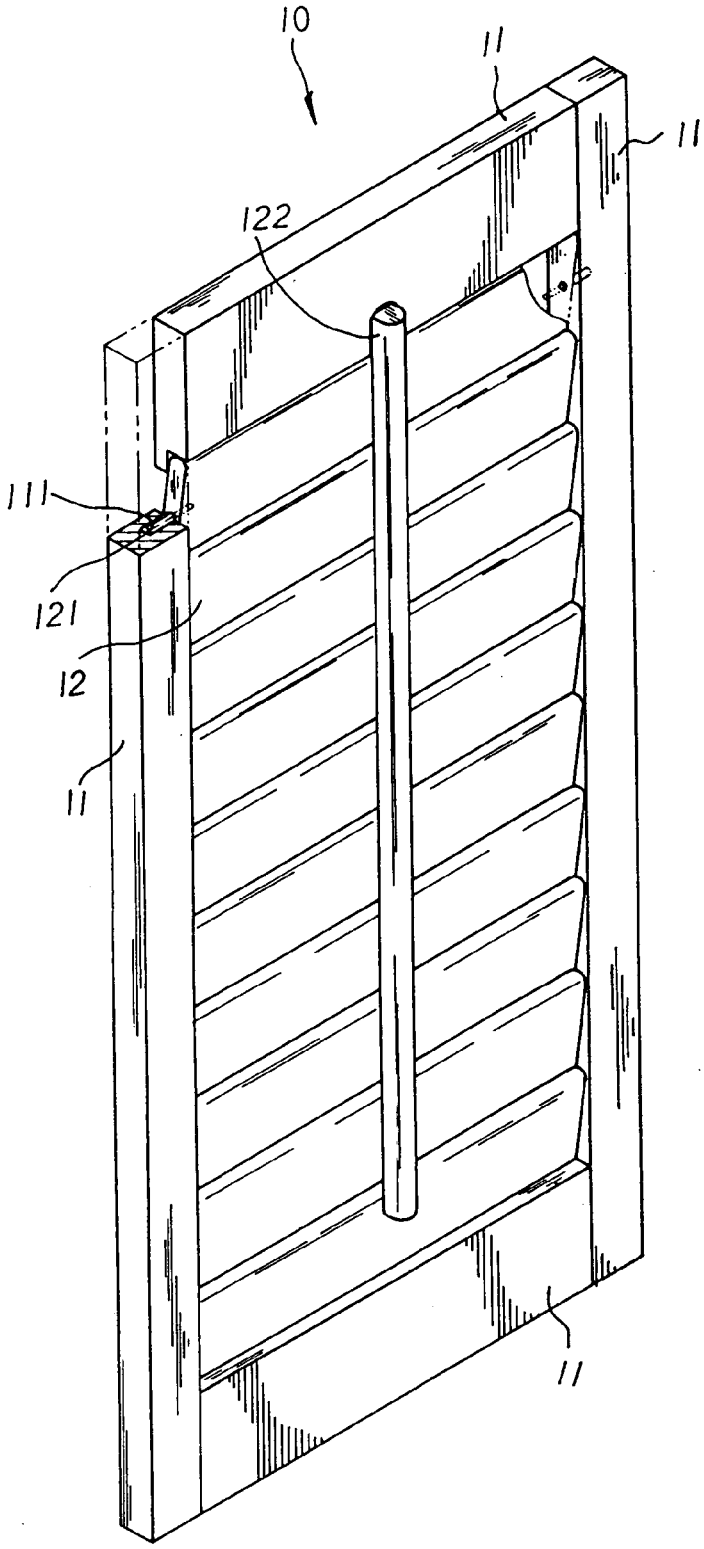
FIG. 1 PRIOR ART
FIG. 1 is a perspective view of a conventional blind slats for door/window Venetian blinds in assembly.
Figure 2:
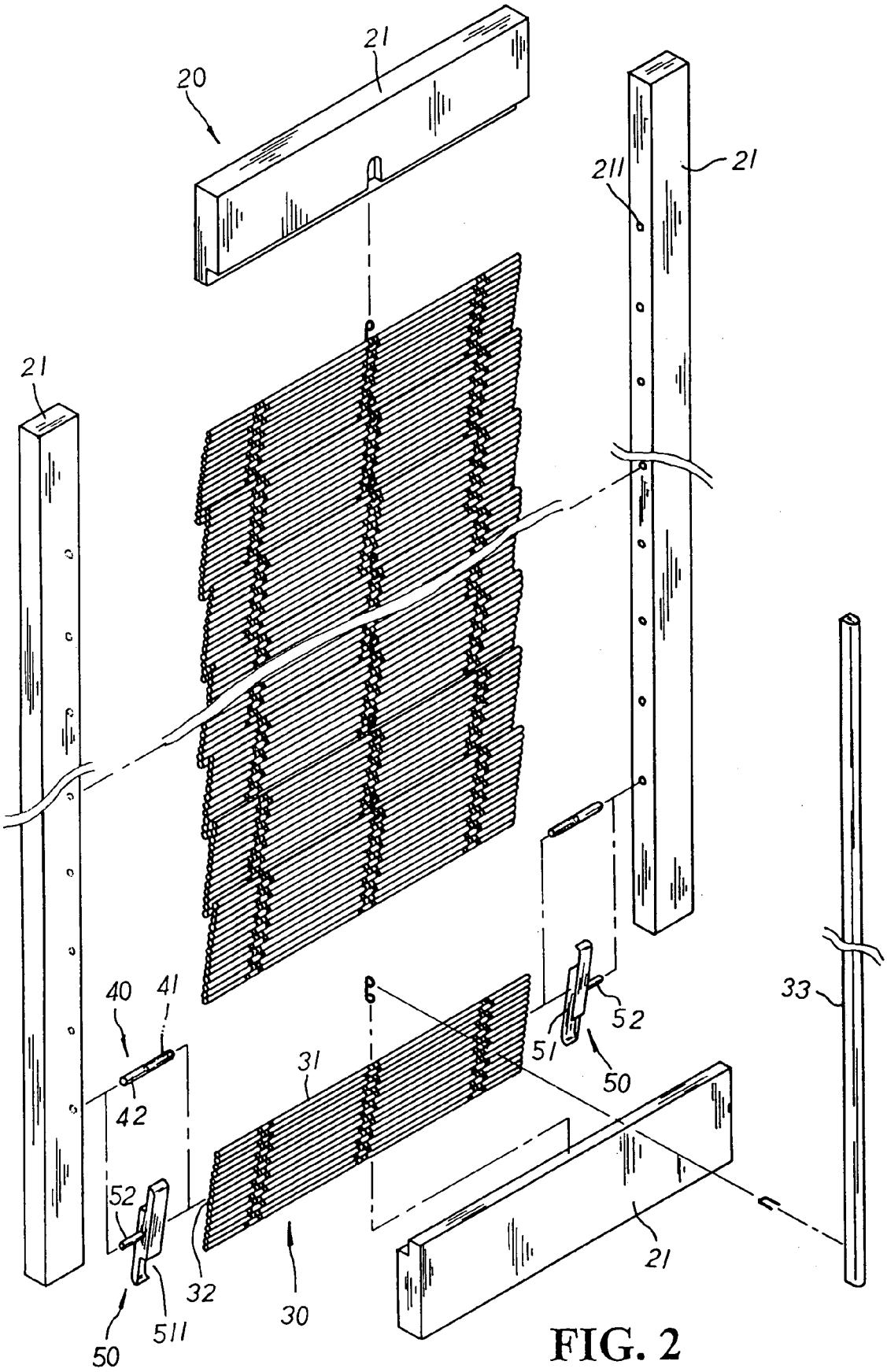
FIG. 2 is a perspective exploded view of the present invention.

Please refer to FIG. 2. The present invention is related to blind slats for door/window Venetian blinds, including a door/window frame 20, blind slats 30, and locating members 40, 50. The door/window frame 20 is made up of a plurality of side brackets 21 wherein the left and right side brackets 21 thereof are respectively equipped with a plurality of retaining holes 211 disposed at the corresponding inner lateral sides thereon. The blind slat 30, a flexible member with proper hardness and thickness that is capable of being elastically twisted and deformed, is made up of a plurality of bamboo rods 31 closely juxtaposed one by one in abutment and properly woven at preset spots to form a bound slat body. Both ends of the central bamboo rod 31 arranged at the middle section of the blind slat 30 thereof are provided with a coupling section 32 respectively, and a linkage rod 33 is attached at the same side of the blind slats 30 assembled onto the door/window frame 20 thereon. The locating member 40, 50 has an engaging groove 41, 51 indented at one side thereon, and a pivotal post 42, 52 protruding at the other side thereof. The engaging groove 41, 51 of the locating member 40 can be either formed into an annular shape correspondingly matched to the radian of the coupling section 32 of the central blind bamboo rod 31 thereof, or made into an elongated grooved shape to fit to the width of the blind slat 30 at both lateral sides thereof. Besides, empty recesses 511 are symmetrically cut at the opposite lateral sides of the engaging groove 51 at the upper and lower sections thereon.

Figure 3:
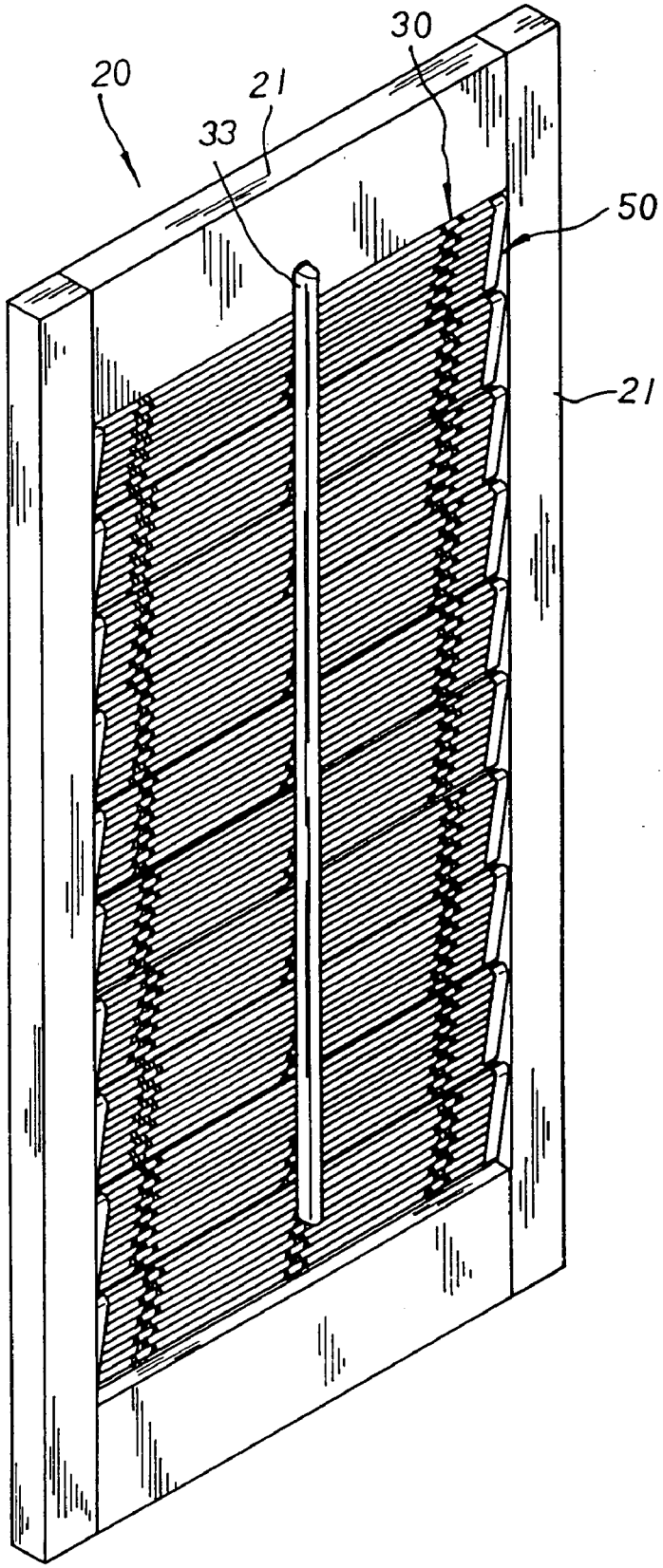
FIG. 3 is a perspective view of the present invention in assembly.
Figure 4:
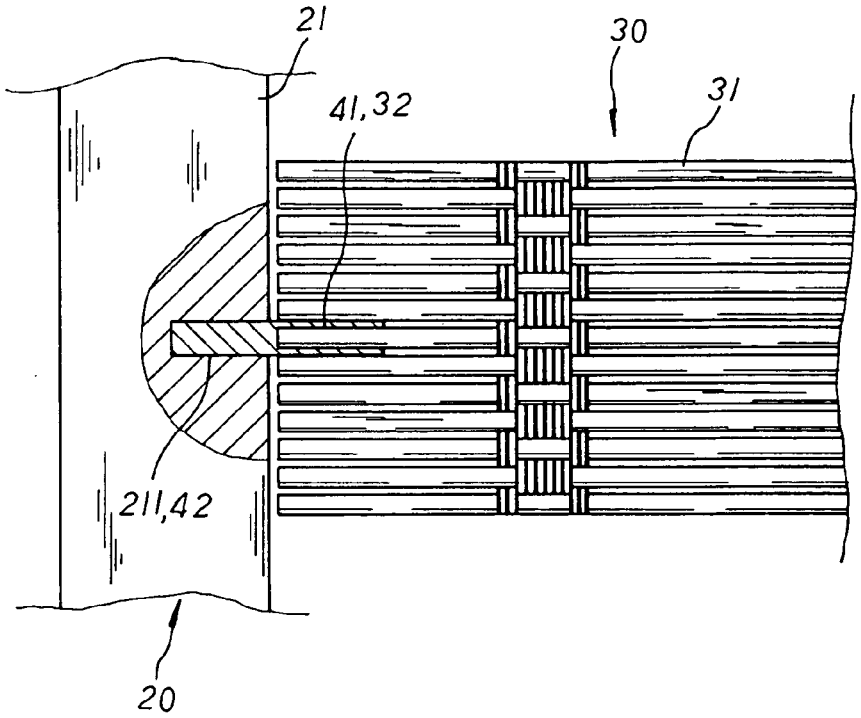
FIG. 4 is a partially enlarged and cross sectional view of the present invention in assembly.
Figure 5:
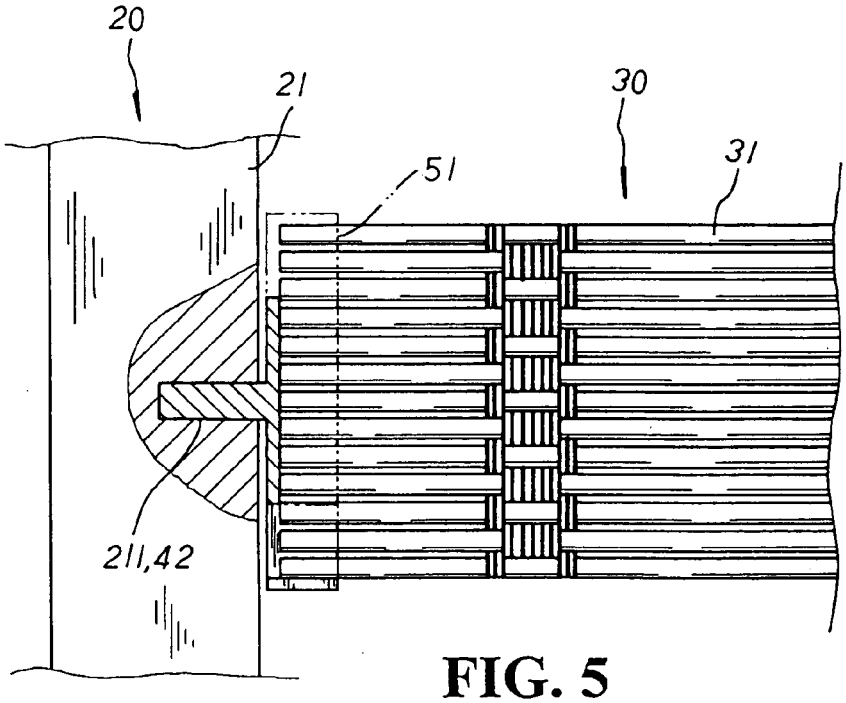
FIG. 5 is another partially enlarged and cross sectional view of the present invention in assembly.

Please refer to FIGS. 3 to 5 inclusive. In assembly, the coupling sections 32 of each blind slat 30 are respectively registered with the annular engaging grooves 41 of the locating member 40 as shown in FIG. 4. Otherwise, the shorter lateral sides of the blind slats 30 are correspondingly mounted to the elongated engaging grooves 51 of the locating member 50 as shown in FIG. 5. The pivotal posts 42 of the locating members 40, 50 are sequentially mounted to the retaining holes 211 of the left/right side brackets 21, permitting the blind slats 30 to be located at the left/right side brackets 21 of the door/window frame 20 thereon. When the blind slats 30 are mounted to the locating members 50 thereof, the empty recesses 511 of the locating members 50 thereof will retain both lateral sides of the blind slats 30 securely therein, abutting tight the juxtaposed blind slats 30 thereof to achieve better sheltering effect thereof The side brackets 21 are sequentially mounted and located to form the door/window frame 20 thereof, and the blind slats 30 are synchronically actuated upwards or downwards by the linkage rod 33 in the folding or unfolding operation of the Venetian blind thereof for the adjustment of sheltering positions thereof to complete the assembly of the present invention.

Figure 6:
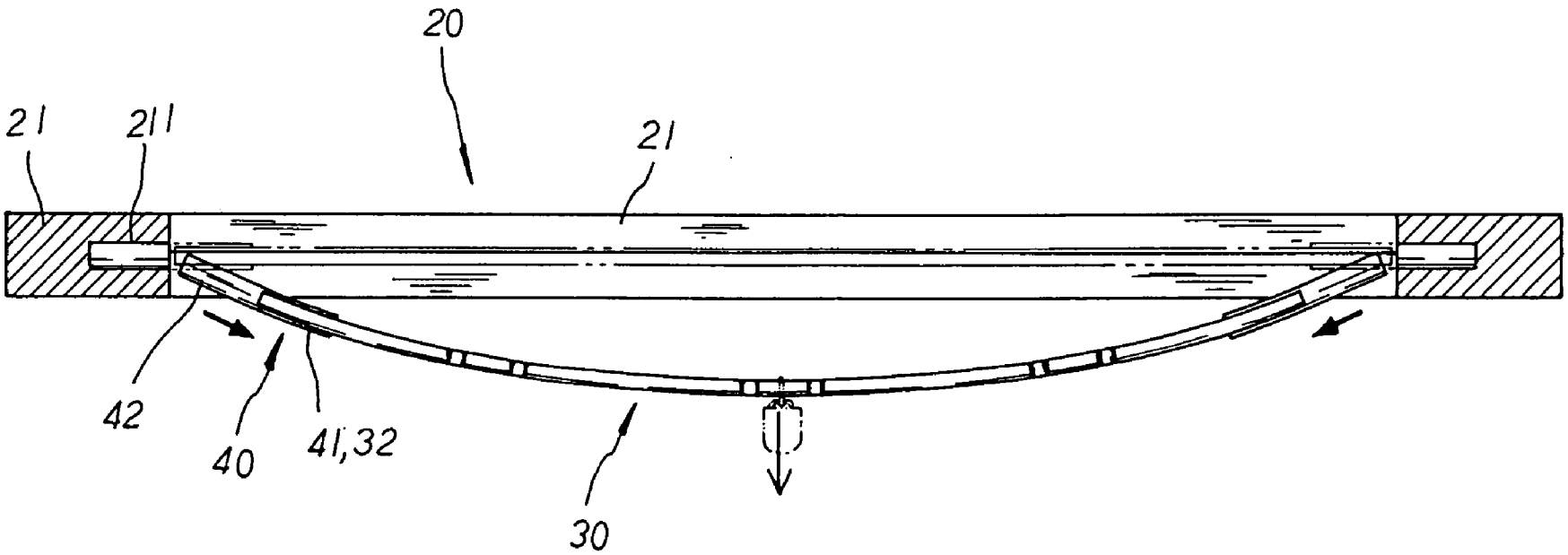
FIG. 6 is a diagram showing the dismantling of a blind slat of the present invention in operation.

Please refer to FIG. 6. Due to the flexibility of the blind slats 30, each blind slat 30 is easily dismounted for variation of different styles or replacement of new ones thereof. The blind slat 30 is pushed at both lateral sides thereof till popped forwards at the middle section thereof and slightly bent into an arc shape, permitting the pivotal posts 42 of the locating members 40 thereof to detach from the retaining hole 211 of the left/right side brackets 21 according to the deformation of the blind slat 30 thereof. Thus, the blind slat 30 to be replaced can be retrieved in a fast and easy manner for the assembly of a new blind slat 30 in the above-mentioned way without the door/window frame 20 being troublesomely dismantled in the operation thereof, facilitating an easy and speedy dismounting as well as assembling of the blind slats 30 for variation or replacement thereof.

Figure 7:
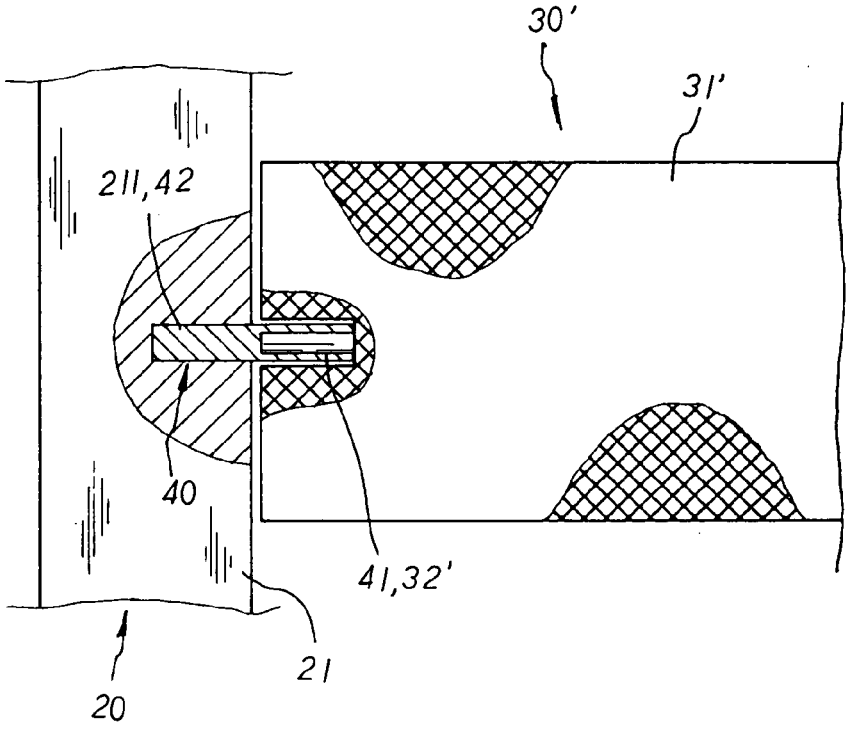
FIG. 7 is a partially enlarged and cross sectional view of another embodiment of the present invention in assembly.
Figure 8:
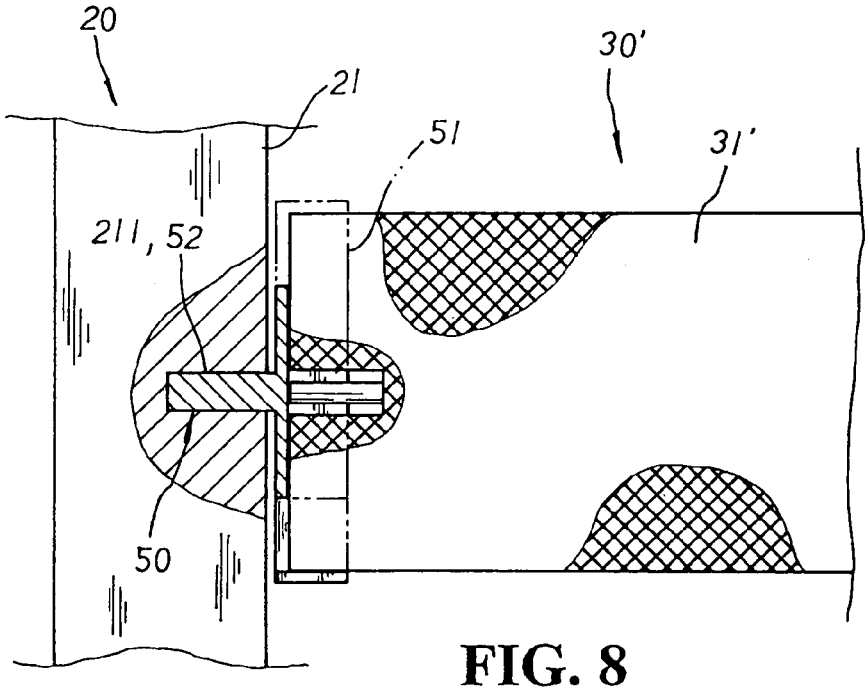
FIG. 8 is another partially enlarged and cross sectional view of another embodiment of the present invention in assembly.

Please refer to FIGS. 7 to 8 inclusive. The present invention can also include a plurality of blind slats 30' each made of board-like flexible woven fabric 31' with proper hardness and thickness. A coupling section 32' is disposed at the middle section of the shorter lateral sides of the woven fabric 31' thereon respectively to be registered with the annular engaging groove 41 of the locating member 40 thereby as shown in FIG. 7. Otherwise, the shorter lateral sides of the woven fabric 31' are respectively retained at the elongated engaging grooves 51 of the locating member 50 as shown in FIG. 8.

Figure 9:
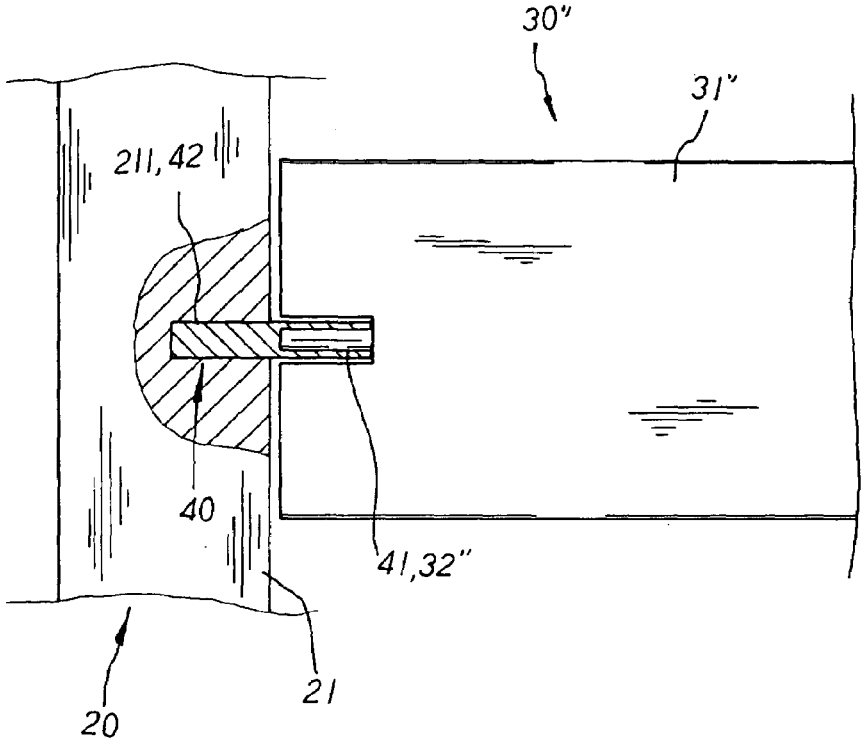
FIG. 9 is a partially enlarged and cross sectional view of a third embodiment of the present invention in assembly.
Figure 10:
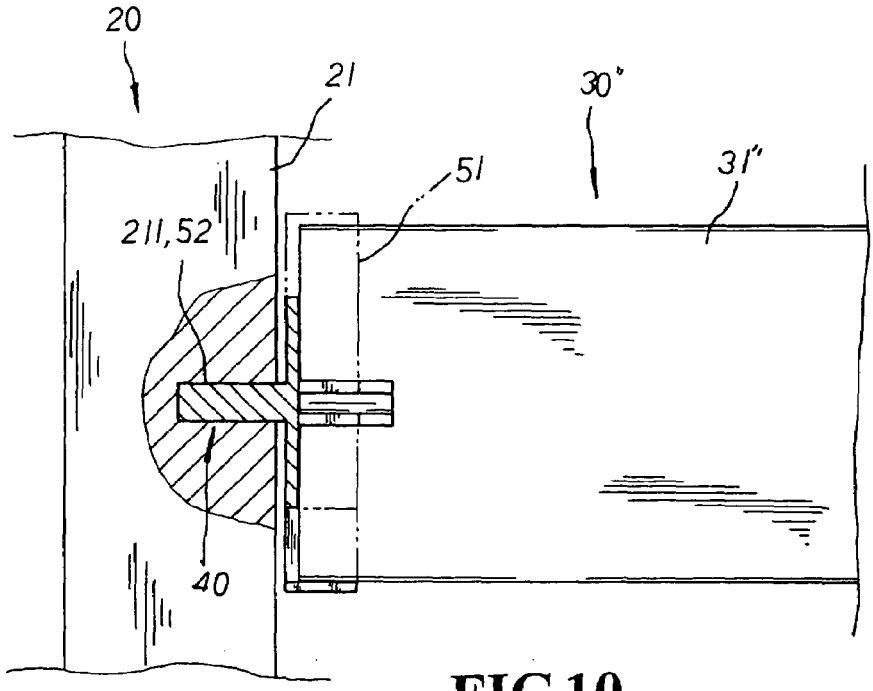
FIG. 10 is anther partially enlarged and cross sectional view of the third embodiment of the present invention in assembly.

Please refer to FIGS. 9 to 10 inclusive. The present invention can also have a plurality of blind slats 30" each made of a flexible plastic plate 31" with proper hardness and thickness wherein a coupling sections 32" is disposed at the middle section of the shorter lateral sides of the plastic plate 31" thereon respectively to be registered with the annular engaging groove 41 of the locating member 40 as shown in FIG. 9. Otherwise, the shorter lateral sides of the plastic plate 31" thereof are respectively retained at the elongated engaging grooves 51 of the locating member 50 as shown in FIG. 10.

What is claimed is:

1. A blind assembly comprising:

a) a frame having a plurality of brackets including a top bracket, a bottom bracket, and two side brackets, each of the two side brackets having a plurality of retaining holes located on an interior of the frame and being equally spaced apart;

b) a plurality of locating members, one of the plurality of locating members is connected to each of the plurality of retaining holes; and c) a plurality of blind slats; one of the plurality of locating members is connected to each of two opposing ends of each of the plurality of blind slats, wherein the plurality of blind slats are pivotally connected to the frame by the plurality of locating members, wherein each of the plurality of locating members has a pivotal post protruding from one side and an engaging groove located in a side opposite the pivotal post, a selected portion of one end of each of the two opposing ends of each of the plurality of blind slats is inserted into each engaging groove, one pivotal post is inserted into each of the plurality of retaining holes, wherein each of the plurality of locating members has first recess formed in a back of a top portion of each engaging groove and a second recess formed in a front of a bottom portion of each engaging groove, a portion of a back surface of each of the plurality of blind slats is visible through the first recess of one of the plurality of locating members, and a portion of a front surface of each of the plurality of blind slats is visible through the second recess of one of the plurality of locating members.

2. The blind assembly according to claim 1, wherein each of the plurality of blind slats includes a plurality of bamboo rods woven together at predetermined intervals along a length of each slat.

3. The blind assembly according to claim 1, wherein each of the plurality of blind slats is made of a woven fabric.

4. The blind assembly according to claim 1, wherein each of the plurality of blind slats is made of a plastic material.

5. The blind assembly according to claim 1, wherein each of the plurality of blind slats has a determined flexibility.

6. The blind assembly according to claim 1, wherein each engaging groove has cross-section having an annular shape.

7. The blind assembly according to claim 1, wherein each engaging groove has an elongated shape, and the selected portion of each of the two opposing ends of each of the plurality of blind slats is a width of the slat.

8. The blind assembly according to claim 1, further comprising a linkage rod connected to an edge of each of the plurality of blind slats.

* * * * *